US006352625B1

(12) United States Patent
Andolfatto et al.

(10) Patent No.: US 6,352,625 B1
(45) Date of Patent: Mar. 5, 2002

(54) SPECIFIC CATHODE, USED FOR PREPARING AN ALKALINE METAL CHLORATE AND METHOD FOR MAKING SAME

(75) Inventors: Françoise Andolfatto, Lyons; François Delmas, Lavera, both of (FR)

(73) Assignee: Atofina (FR)

( * ) Notice: Subject to any disclaimer, the term of this patent is extended or adjusted under 35 U.S.C. 154(b) by 0 days.

(21) Appl. No.: 09/623,620

(22) PCT Filed: Feb. 11, 1999

(86) PCT No.: PCT/FR99/00304

§ 371 Date: Nov. 6, 2000

§ 102(e) Date: Nov. 6, 2000

(87) PCT Pub. No.: WO99/45175

PCT Pub. Date: Sep. 10, 2000

(30) Foreign Application Priority Data

Mar. 2, 1998 (FR) ..... 98/02485

(51) Int. Cl.[7] ..... C25B 11/00

(52) U.S. Cl. ..... 204/290.12; 204/290.13; 204/290.14; 204/290.11; 204/290.01

(58) Field of Search ..... 204/290.01, 290.11, 204/290.12, 290.13, 290.14, 290.09

(56) References Cited

U.S. PATENT DOCUMENTS

| | | | | | |
|---|---|---|---|---|---|
| 4,133,730 | A | * | 1/1979 | Du Bois et al. | 204/290.13 |
| 4,530,742 | A | * | 7/1985 | Carlin et al. | 204/290.14 |
| 4,585,540 | A | * | 4/1986 | Beer et al. | 204/290.14 |
| 4,589,969 | A | * | 5/1986 | Yurkov et al. | 204/290.14 |
| 5,017,276 | A | * | 5/1991 | Alford et al. | 204/290.14 |
| 5,503,663 | A | * | 4/1996 | Tsou | 204/290.14 |
| 5,855,751 | A | * | 1/1999 | Rangarajan et al. | 204/290.14 |
| 6,017,430 | A | * | 1/2000 | Hodgson et al. | 204/290.14 |
| 6,071,570 | A | * | 6/2000 | Hardee | 204/290.12 |
| 6,123,816 | A | * | 9/2000 | Hodgson | 204/290.12 |
| 6,217,729 | B1 | * | 4/2001 | Zolotarsky et al. | 204/290.13 |

* cited by examiner

*Primary Examiner*—Bruce F. Bell
(74) *Attorney, Agent, or Firm*—Pennie & Edmonds LLP

(57) ABSTRACT

The invention relates to a specific cathode comprising a substrate made of an element chosen from the group formed by titanium, nickel, tantalum, zirconium, niobium and alloys thereof, the said substrate being coated with an interlayer of a mixed oxide based on titanium and on ruthenium and with an external layer of metal oxides comprising titanium, zirconium and ruthenium. The subject of the invention is also its manufacturing process and its applications in electrolysis.

17 Claims, No Drawings

SPECIFIC CATHODE, USED FOR PREPARING AN ALKALINE METAL CHLORATE AND METHOD FOR MAKING SAME

The present invention relates to a cathode, which can be used for the preparation of an alkali metal chlorate by electrolysis of the corresponding chloride, and its manufacturing process.

Although the activation of cathodes for the electrolytic synthesis of sodium chlorate has formed the subject of many papers, there have, however, been very few studies devoted to the formation of specific cathodes.

It is known that, in the electrolytic preparation of sodium chlorate, there are, in parallel with the reactions leading to the final product, many secondary reactions. Thus, at the cathode, apart from the reduction of water to hydrogen, a hypochlorite ion reduction reaction occurs.

Sodium chlorate is manufactured on an industrial scale in electrolytic cells, each of them comprising several mild-steel cathodes and several titanium anodes coated with ruthenium oxide. They are generally supplied with an electrolytic solution consisting of approximately 100 g/l of sodium chloride, of approximately 600 g/l of sodium chlorate and of sodium dichromate in an amount lying between 2 and 5 g/l. The latter is used to reduce or even eliminate the hypochlorite ion reduction reaction.

Despite the major role played by the dichromate in the reduction of hypochlorite ions and its ease of use, chromium (VI) is at the present time under threat because the alkali metal chlorate thus prepared requires a purification step, but above all because it pollutes the environment. Consequently, it is obviously important, from an ecological standpoint, to find a replacement solution.

Thus, document U.S. Pat. No. 4,295,951 proposes the use of a cathode whose substrate, made of titanium, iron or a titanium alloy, is coated with a non-conducting protective layer consisting of a film of halopolymers, such as Teflon®.

Moreover, French Patent FR 2,311,108 has disclosed a cathode in which the substrate is a plate made of titanium, zirconium, niobium or an alloy essentially consisting of a combination of these metals and applied to this substrate is a layer of a metal oxide, essentially consisting of an oxide of one or more metals chosen from ruthenium, rhodium, palladium, osmium, iridium and platinum and optionally an oxide of one or more metals chosen from calcium, magnesium, strontium, barium, zinc, chromium, molybdenum, tungsten, selenium and tellurium.

However, according to LINDBERGH and SIMONSON, Journal of the Electrochemical Society, 1990, Vol. 137, No. 10, p. 3094–3099, these cathodes only allow the kinetics of the hypochlorite ion reduction reaction to be slowed down but do not allow the reaction to be eliminated.

The Applicant has now discovered a cathode which allows the hypochlorite ion reduction reaction to be inhibited while still retaining good properties with respect to the water reduction reaction.

This specific cathode comprises a substrate made of an element chosen from the group formed by titanium, nickel, tantalum, zirconium, niobium and alloys thereof, the said substrate being coated with an interlayer of a mixed oxide based on titanium and on ruthenium and with an external layer of metal oxides comprising titanium, zirconium and ruthenium.

Advantageously, the interlayer contains a mixed oxide of titanium and ruthenium.

Preferably, the external layer of metal oxides contains titanium, zirconium and ruthenium.

Better still, the external layer mainly consists of $ZrTiO_4$ accompanied by $RuO_2$ and optionally by $ZrO_2$ and/or $TiO_2$.

According to the invention, it is preferable to use, as substrate, titanium or nickel or alloys of titanium or nickel. Better still, it is preferred to use titanium.

The ruthenium/titanium molar ratio in the interlayer preferably lies between 0.4 and 2.4.

The zirconium/titanium molar ratio in the external layer generally lies between 0.25 and 9, preferably between 0.5 and 2.

The ruthenium in the external layer represents between 0.1 and 10 mol %, preferably between 0.1 and 5 mol % with respect to the metals in the composition of this layer.

Another subject of the invention is the process for preparing the specific cathode, comprising the following steps:

a) pretreatment of a substrate in order to give the surface roughness characteristics, b) coating of the pretreated substrate using a solution A containing essentially titanium and ruthenium, followed by drying and then calcining of the substrate thus coated, c) coating of the substrate obtained at b) using a solution B comprising titanium, zirconium and ruthenium, followed by drying and calcining of the substrate.

The pretreatment generally consists in subjecting the substrate either to sand blasting followed by washing in acid, or to pickling using an aqueous solution of oxalic acid, hydrofluoric acid, a mixture of hydrofluoric acid and nitric acid, a mixture of hydrofluoric acid and glycerol, a mixture of hydrofluoric acid, nitric acid and glycerol or a mixture of hydrofluoric acid, nitric acid and hydrogen peroxide, followed by washing one or more times in degasified demineralized water.

The substrate may be in the form of a solid plate, a perforated plate, expanded metal or a cathode basket made from expanded or perforated metal.

Solution A is generally prepared by making essentially an inorganic or organic salt of titanium and of ruthenium react, at room temperature and with stirring, with water or in an organic solvent, optionally in the presence of a chelating agent. The temperature may be raised slightly above room temperature in order to help to dissolve the salts.

Advantageously, an inorganic or organic salt of titanium and of ruthenium are made to react with water or in an organic solvent, optionally in the presence of a chelating agent.

The titanium and ruthenium are preferably each present in solution A with a concentration ranging from 0.5 to 10 mol/l.

Solution B is generally prepared by making an inorganic or organic salt of titanium, of zirconium, of ruthenium and optionally of other metals react, at room temperature and with stirring, with water or in an organic solvent, optionally in the presence of a chelating agent. When the reaction is exothermic, an ice bath is used to cool the reaction mixture.

Advantageously, an inorganic or organic salt of titanium, of zirconium and of ruthenium is made to react with water or in an organic solvent, optionally in the presence of a chelating agent.

The preferred salts of titanium and of ruthenium are chlorides, oxychlorides, nitrates, oxynitrates, sulphates and alkoxides. Advantageously, ruthenium chlorides, titanium chlorides and titanium oxychlorides are used.

As zirconium salts, chlorides, sulphates, zirconyl chlorides, zirconyl nitrates, and alkoxides, such as butyl zirconate, may be used.

Zirconium and zirconyl chlorides are particularly preferred.

As organic solvent, mention may be made of light alcohols, preferably isopropanol and ethanol and even more preferably absolute Isopropanol and absolute ethanol.

Although water or an organic solvent can be used, indiscriminately, to prepare solution B, it is preferred, however, to use an organic solvent when the metal salts are solid at room temperature.

Thus, when the metal salt is zirconium chloride, absolute ethanol or absolute isopropanol are used as solvent.

Titanium and zirconium are generally each present in solution B with a concentration ranging from 0.5 to 5 mol/l. The ruthenium concentration in solution B is generally between $10^{-3}$ and $10^{-1}$ mol/l, preferably between $10^{-3}$ and $5\times10^{-2}$ mol/l.

Solution A may be deposited on the pretreated substrate by using various techniques, such as sol-gel, electroplating, galvanic electrodeposition, spraying or coating. Advantageously, the pretreated substrate is coated with solution A, for example using a brush. The substrate thus coated is then dried in air and/or in an oven at a temperature of less than 150° C. After drying, the substrate is calcined in air at a temperature of between 300 and 600° C. and preferably of between 450 and 550° C. for a time ranging from 10 minutes to 2 hours.

For step (c) of the process according to the present invention, the same deposition techniques and the same drying and calcining operating conditions as in step (b) may be used except that the deposition is carried out with solution B.

Other techniques, such as chemical vapour deposition (CVD), physical vapour deposition (PVD) and plasma spraying, are also suitable for coating the pretreated substrate with an interlayer and with an external layer.

Solution A may be deposited equally well on one side and on both sides of the pretreated substrate. Solution B may also be deposited on both sides of the substrate coated with the interlayer.

Depending on the thickness of the interlayer desired, step (b) of the process may be repeated several times. Likewise, step (c) of the process may be repeated several times.

The thickness of the interlayer generally corresponds to a coverage of between 2 and 60 g/m$^2$ of substrate and preferably between 20 and 35 g/m$^2$.

The concentration of solution A is judiciously chosen so that this preferred thickness can be obtained by repeating step (b) a reasonable number of times, preferably between 1 and 4 times.

The thickness of the outer layer corresponds to a coverage of between 5 and 70 g/m$^2$ of the substrate and preferably between 25 and 50 g/m$^2$. Solution B is generally prepared so that its concentration allows a thickness of external layer to be obtained which is in the preferred range by repeating step (c) less than 10 times, preferably between 2 and 5 times.

According to another object of the invention, the specific cathode may be used in the preparation of an alkali metal chlorate by electrolysis of the corresponding chloride.

The specific cathode according to the invention is particularly suitable for the preparation of sodium chlorate.

The use of the specific cathode in conjunction with an anode allows the chlorate of an alkali metal to be electrolytically synthesized with a high coulombic yield and in the absence of sodium dichromate.

As anode, mention may be made of dimensionally stable anodes (or DSAs) which consist of a titanium substrate coated with a layer of a mixed oxide of titanium and ruthenium. The ruthenium/titanium molar ratio in this layer is advantageously between 0.4 and 2.4.

The following examples illustrate the invention without limiting it.

EXPERIMENTAL PART

I—Preparation of the Cathode a) Pretreatment and Deposition of the Interlayer

A titanium plate 2 mm in thickness and having the dimensions 2 cm×15 cm is sand blasted and then rinsed with a dilute hydrochloric acid solution in order to remove any traces of contamination.

A solution A, containing ruthenium and titanium in equimolar amounts, is prepared by mixing, at room temperature and with stirring, 2.45 g of $RuCl_3$, of greater than 98% purity, 3.64 cm$^3$ of $TiOCl_2.2HCl$ containing 127 g/l of Ti, and 2.5 cm$^3$ of absolute isopropanol.

Next, the end of one side of the pretreated plate, representing an area of dimensions 2 cm×5 cm, is coated with solution A using a brush and then left for 30 minutes at room temperature. Next, the coated plate is dried for 30 minutes in an oven at 120° C. and then calcined in air in a furnace at 500° C. for 30 minutes.

These operations (coating, drying and calcining) are repeated 3 more times and, after these 4 coatings, a layer of Ru—Ti mixed oxide corresponding to a coverage of approximately 30 g/m$^2$ of the plate is obtained.

b) Deposition of the External Layer

General Operating Method

A zirconium, ruthenium and titanium precursor is mixed, with stirring, with water or absolute ethanol. Solution B, thus formed, is cooled using an ice bath and continuously stirred until it is used.

The plate coated in (a) is then coated with solution B using a brush. Next, the plate is dried for 30 minutes in an oven at 120° C. and then calcined in air in a furnace at 500° C. for 30 minutes.

These operations (coating, drying and calcining) are repeated several times until an external layer corresponding to a coverage of between 30 and 45 g/m$^2$ of the plate is obtained.

II—Evaluation of the Cathode

The following three electrolytic solutions are used to evaluate the specific cathode thus prepared:

(i) a 1N NaOH solution at 25° C., in order to study the evolution of hydrogen, (ii) a 1N NaOH solution at 25° C. containing 5 g/l of NaClO in order to study the reduction of the hypochlorite ions, and (iii) a 1N NaOH solution at 25° C. containing 5 g/l of NaClO and 5 g/l of $Na_2Cr_2O_7.2H_2O$, in order to study the elimination of the hypochlorite ion reduction by the action of the dichromate.

Using a standard calomel electrode (SCE), the electrolytic solution (i) allows us to characterize the electrode by the value of the cathode potential, $E_{cath}$, for a given current density.

The current/voltage curve obtained with the electrolytic solution (ii) has a current plateau between −0.8 and −1.2 V/SCE. The value corresponding to this plateau is the limiting current for hypochlorite ion reduction, $i_{red}$.

The current/voltage curve recorded during the evaluation of the cathodes using the electrolytic solution (iii) gives us the limiting current for hypochlorite ion reduction in the presence of sodium dichromate, $i_{red}(Cr)$, by measuring the residual current between −0.8 and −1.2 V/SCE.

III—EXAMPLES

Example 1

Solution B is prepared by mixing, with stirring, 5.83 g of $ZrCl_4$, 0.01 g of $RuCl_3$, 2.74 cm$^3$ of $TiCl_4$ and 10 cm$^3$ of absolute ethanol in a container cooled using an ice bath.

Next, the plate coated with the interlayer is coated with solution B thus prepared and then dried and calcined in air as indicated in the general operating method. These operations are repeated 4 times and, after the final calcining, the mass of external layer is 30 g/m$^2$ of the plate.

The cathode thus prepared was evaluated using the electrolytic solutions described above.

The hydrogen evolution study gives a cathode potential value $E_{cath}$=−1.28 V/SCE for a current density of 2 kA/m$^2$ (20 A/dm$^2$).

The values of the limiting current for hypochlorite ion reduction in the presence and in the absence of dichromate are given in the table below.

Examples 2–7

This table also gives the value of the cathode potential for a current density of 2 kA/m$^2$ and the value of the limiting current for the various cathodes prepared according to the general operating method, but with a composition of the external layer which is different from that used in Example 1.

Comparative Examples 8 and 9

A mild-steel cathode (Example 8) and a plate made of titanium coated with the interlayer according to (I-a) (Example 9) were evaluated under the same conditions as the cathodes prepared according to the invention.

In the case of Example 8, the cathode potential was determined in the presence of dichromate.

Unlike the cathodes according to Examples 8 and 9, the plateau in the current/voltage curve observed with the electrolytic solution (ii), using the cathodes prepared according to the invention, is greatly reduced or even non-existent.

5. Cathode according to claim 1, characterized in that the external layer of metal oxides contains titanium, zirconium and ruthenium.

6. Cathode according to claim 5, characterized in that the external layer essentially consists of $ZrTiO_4$ accompanied by $RuO_2$ and optionally by $ZrO_2$ and/or $TiO_2$.

7. Cathode according to one of claim 1, characterized in that the ruthenium/titanium molar ratio in the interlayer lies between 0.4 and 2.4.

8. Cathode according to one of claim 1, characterized in that the zirconium/titanium molar ratio in the external layer lies between 0.25 and 9.

9. Cathode according to claim 8, characterized in that the zirconium/titanium molar ratio lies between 0.5 and 2.

10. Cathode according to claim 1, characterized in that the ruthenium in the external layer represents between 0.1 and 10 mol % with respect to the metal oxides in the composition of the external layer.

11. Cathode according to claim 10, characterized in that the ruthenium in the external layer represents between 0.1 and 5 mol %.

12. Process for obtaining a cathode according to one of claims 1 to 11, comprising the following steps:

a) pretreatment of the substrate, b) coating of the pretreated substrate, using a solution A containing essentially titanium and ruthenium, followed by drying and then calcining, c) coating of the substrate obtained at (b), using a solution B comprising titanium, zirconium and ruthenium, followed by drying and calcining.

13. Process according to claim 12, characterized in that the drying of step (b) and/or (c) are/is carried out in air and/or in an oven at a temperature of less than 150° C.

TABLE

| EXAMPLE | PRECURSOR | | | SOLVENT | MOLAR RATIO Zr/Ti | MOLAR RATIO Ru/(Zr + Ti + Ru) | $E_{cath}$ (V/SCE) | $i_{red}$ (A/m$^2$) | $i_{red}$ (Cr) (A/m$^2$) | $i_{red}/i_{red}$ (Cr) |
|---|---|---|---|---|---|---|---|---|---|---|
| 1 | $ZrCl_4$ | $TiCl_4$ | $RUCl_3$ | Absolute ethanol | 1 | 0.001 | −1.28 | −30 | −30 | 1 |
| 2 | $ZrOCl_2$ | $TiOCl_2$ | $RuCl_3$ | Absolute ethanol | 2 | 0.02 | −1.27 | −30 | −25 | 1.2 |
| 3 | $ZrOCl_2$ | $TiOCl_2$ | $RuCl_3$ | Absolute ethanol | 0.5 | 0.02 | −1.32 | −45 | −35 | 1.28 |
| 4 | $ZrOCl_2$ | $TiOCl_2$ | $RuCl_3$ | Absolute ethanol | 1 | 0.02 | −1.28 | −25 | −20 | 1.25 |
| 5 | $ZrOCl_2$ | $TiOCl_2$ | $RuCl_3$ | Water | 1 | 0.02 | −1.33 | −78 | −30 | 2.6 |
| 6 | $ZrCl_4$ | $TiCl_4$ | $RuCl_3$ | Absolute ethanol | 1 | 0.02 | −1.28 | −85 | −75 | 1.13 |
| 7 | $ZrCl_4$ | $TiCl_4$ | $RuCl_3$ | Absolute ethanol | 1 | 0.005 | −1.25 | −70 | −40 | 1.75 |
| 8 | | | | | | | −1.37 | −400 | −30 | 13.3 |
| 9 | | | | | | | −1.26 | −500 | −35 | 14.3 |

What is claimed is:

1. Cathode comprising a substrate made of titanium, nickel, tantalum, zirconium or niobium or mixtures thereof, an interlayer of a mixed oxide based on titanium and on ruthenium, and an external layer of metal oxides comprising titanium, zirconium and ruthenium.

2. Cathode according to claim 1, characterized in that the substrate is made of nickel or titanium or of nickel or titanium alloys.

3. Cathode according to claim 2, characterized in that the substrate is made of titanium.

4. Cathode according to one of claims 1 to 3, characterized in that the interlayer is a mixed oxide of titanium and of ruthenium.

14. Process according to claim 12, characterized in that step (b) and/or step (c) is/are repeated.

15. Cathode according to claim 1, wherein the cathode is obtained by a process characterized in that the calcining of step (b) and/or (c) are/is carried out in air at a temperature lying between 300 and 600° C.

16. Process according to claim 15, characterized in that the calcining temperature lies between 450 and 550° C.

17. Process for manufacturing an alkali metal chlorate by electrolysis of the corresponding chloride using a cathode according to one of claim 1.

* * * * *